United States Patent [19]

Reynolds

[11] 3,967,404

[45] July 6, 1976

[54] COMBINATION CARTRIDGE EXTRACTOR-EJECTOR

[75] Inventor: George L. Reynolds, Cambridge, Ill.

[73] Assignee: The United States of America as represented by the Secretary of the Army, Washington, D.C.

[22] Filed: Nov. 15, 1974

[21] Appl. No.: 524,286

[52] U.S. Cl. ..... 42/25
[51] Int. Cl.[2] ..... F41C 15/00
[58] Field of Search ..... 42/25

[56] References Cited

UNITED STATES PATENTS

| | | | |
|---|---|---|---|
| 2,465,553 | 3/1949 | Robinson, Jr. | 42/25 |
| 2,603,019 | 7/1952 | Elkas | 42/25 |
| 2,603,020 | 7/1952 | Hussey | 42/25 |
| 2,869,268 | 1/1959 | Sefried et al. | 42/25 |
| 3,021,634 | 2/1962 | Johnson | 42/25 |

*Primary Examiner*—Charles T. Jordan
*Attorney, Agent, or Firm*—Nathan Edelberg; A. Victor Erkkila; Ronald M. Spann

[57] ABSTRACT

A combination cartridge extractor-ejector device includes a bolt provided with loop of spring steel having a hook end and a spring end projecting therefrom. When the bolt is moved against the cartridge case in the gun breech, the hook slides over and engages the flanged rim of the case while the spring is compressed against the case end; and when the bolt is moved away from the breech sufficient to extract the engaged case, the spring causes the case to pivot on the hook sufficient to disengage the rim from the hook and thereby eject the case from the gun.

6 Claims, 5 Drawing Figures

COMBINATION CARTRIDGE EXTRACTOR-EJECTOR

GOVERNMENTAL INTEREST

The invention described herein may be manufactured, used and licensed by or for the Government for governmental purposes without the payment to me of any royalty thereon.

BACKGROUND OF THE INVENTION

At the present state of the art, extractor and ejector devices are well known, especially in firearms of the cartridge-firing type.

A combination extractor and ejector is found on many double barrelled shotguns, wherein the extractor-ejector is actuated by a cam follower resiliently connected to the extractor-ejector.

SUMMARY OF THE INVENTION

In accordance with the present invention, a firearm or analogous mechanism is provided with a device which performs the dual function of extracting and ejecting a cartridge having a rear flanged rim from the breech of the firearm.

The device comprises a bolt or the like, which is provided with a hook means and a biasing means projecting therefrom. The hook means is adapted to slide over and engage the flanged rim of the cartridge case while the biasing means is adapted to simultaneously press against the rear end of the case when the bolt is moved against the breech; and when the bolt is moved away from the breech sufficient to extract the case, the biasing means causes the case to pivot on the hook sufficient to disengage the flanged rim from said hook and thereby eject the case from the firearm.

BRIEF DESCRIPTION OF THE DRAWINGS

Throughout the following description like reference numerals are used to denote like parts of the drawings.

DESCRIPTION OF THE PREFERRED EMBODIMENTS

Figure 1:
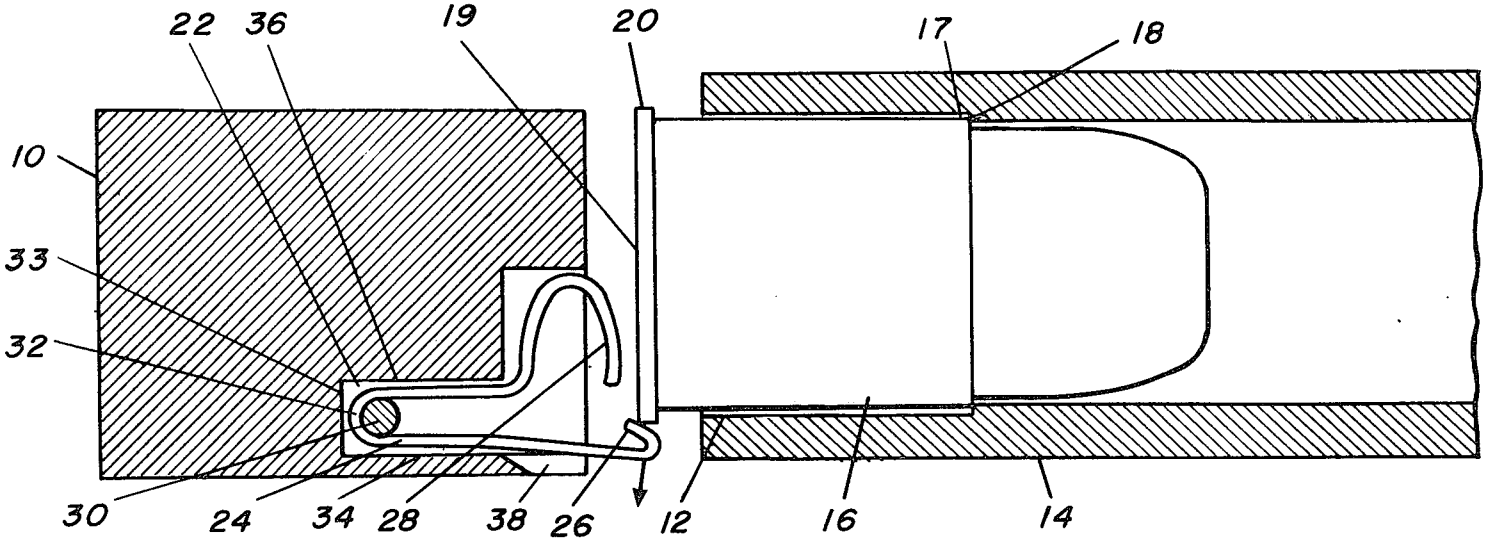
FIG. 1 is an axial section view of a portion of a firearm showing the breech bolt approaching the cartridge in the barrel.

FIG. 1 shows a bolt 10 which is aligned with the breech 12 of rifle barrel 14. The breech contains a cartridge case 16, whose forward end 17 abuts shoulder 18 in breech 12 and whose rear end 19 with flanged rim 20 projects from said breech. Bolt 10 contains a recess 22 for receiving the extractor-ejector device 24, which consists of a bifurcated or U-shaped piece which is fabricated of a flat strip of spring steel or other suitable resilient material. One leg of said device terminates in an extractor hook 26 while the other leg terminates in an inverted U-shaped ejector spring biasing means 28, whose legs are approximately perpendicular to the main legs of device 24. A removable pin 30 mounted in bolt 10 passes through the crotch 32 of the bifurcated device 24, whereby the latter is restrained against forward movement by said pin 30 and against rearward movement by the rear wall 33 of said recess. In addition, the walls 34 and 36 of bolt recess 22 restrain the main legs of the extractor-ejector device 24, such that the forward end of the leg carrying the extractor hook 26 must be depressed into an opening or depression 38 in the forward part of recess wall 34 in order to slide over and snap onto the cartridge case flanged rim 20. The extractor hook 26 and the ejector spring 28 project beyond the front end of bolt 10 and cooperate in such a manner that when the hook 26 catches the flanged rim 20 of cartridge case 16, the ejector spring 28 exerts pressure on the case rear end 19, which causes the cartridge case 16 after removal from the breech 12 to pivot on said hook through a sufficient angle and be released.

Figure 2:
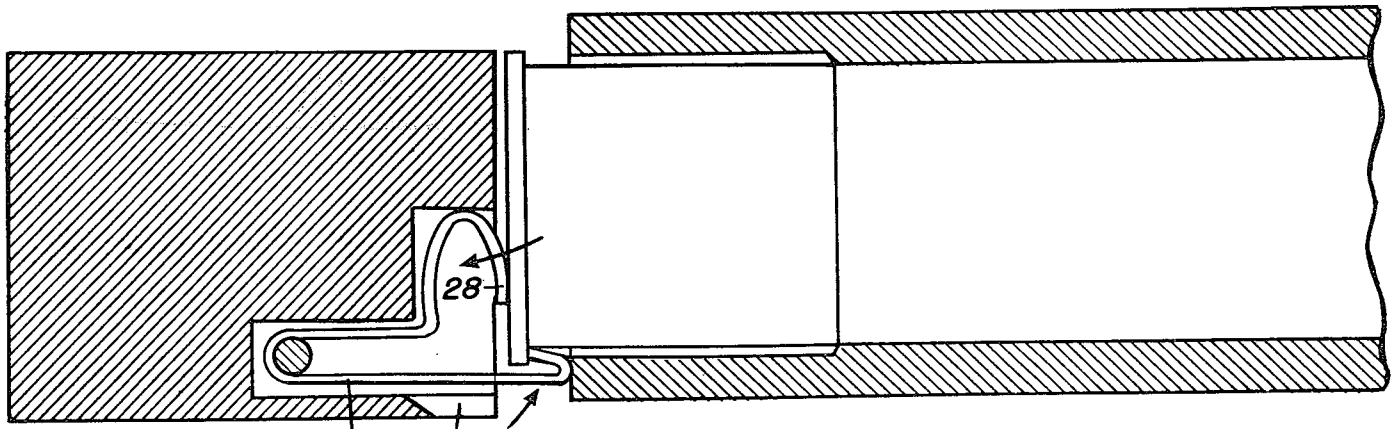
FIG. 2 is a similar view showing the breech bolt in closed position.
Figure 3:
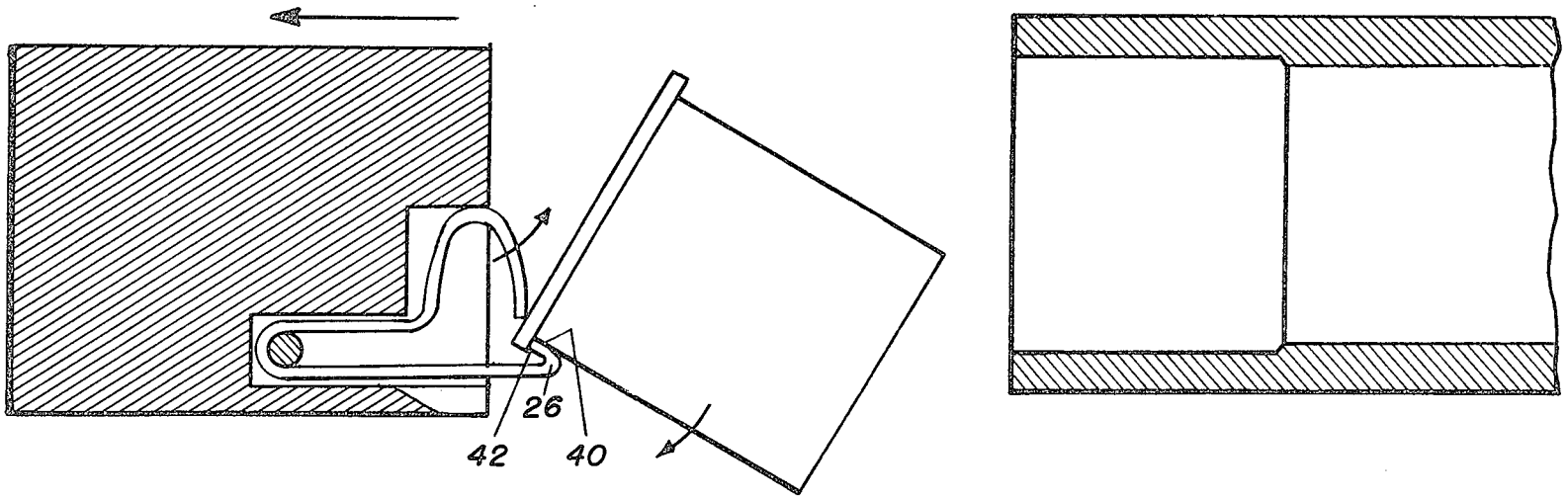
FIG. 3 is a similar view showing the empty cartridge case being ejected as the breech bolt moves rearward relative to the barrel.

In operation, when the bolt 10 is moved forward, the extractor hook 26 cams over the flanged rim 20 of the cartridge case 16, as shown in FIG. 1, and finally catches on said rim while ejector spring 28 is simultaneously compressed, as shown in FIG. 2. When bolt 10 is moved rearward sufficient to remove the cartridge case from the breech, the ejector spring 28 expands against the case rear end 19, thereby forcing the cartridge case 16 to pivot on the ejector hook 26, which is shaped so that it no longer catches the case rim 20 after the case pivots through a sufficient angle, and thus be ejected from the weapon as shown in FIG. 3. Specifically, as the cartridge case is forced to pivot on hook 26, the loop 40 of hook 26 meets the case wall, which forces the tip 42 of said hook to fall beneath and disengage flanged rim 20, thereby causing the case to be ejected from the weapon.

Figure 4:
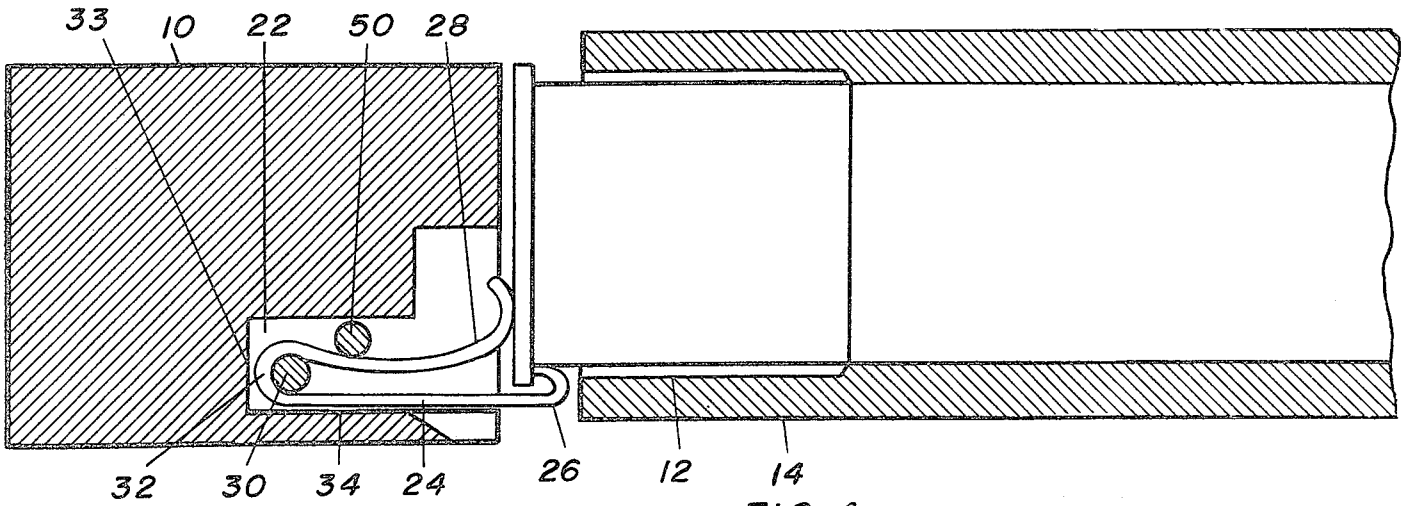
FIG. 4 is an axial section view of a portion of a firearm showing the breech bolt in firing position against a cartridge designed to remain partly extended from the breech of the barrel when the cartridge is fired.

FIG. 4 shows a bolt 10 which is aligned with the breech 12 of barrel 14. Bolt 10 contains a recess 22 for receiving the extractor-ejector device 24 which consists of a bifurcated or U-shaped strip of spring steel. One leg of said device terminates in an extractor hook 26 of the type shown in FIGS. 1–3; however, the other ejector spring leg 28 is bent in the form of a broad convex curve. A removable pin 30 mounted in bolt 10 passes through the crotch 32 of the U-shaped device 24, whereby the latter is restrained against forward movement by said pin 30 and against rearward movement by the rear wall 33 of said recess. In addition, the wall 34 of bolt recess 22 and removable pin 50 mounted in the bolt restrain the main legs of the extractor-ejector device 24, such that the forward end of the leg carrying the extractor hook 26 is depressed in order to slide over and snap onto the cartridge case flanged rim 20. The extractor hook 26 and the ejector spring 28 project beyond the front end of bolt 10 and cooperate in such a manner that when the hook 26 catches the rim 20 of cartridge case 16, the ejector spring 28 is compressed and thereby exerts pressure on the case rear end 19, which causes the cartridge case 16 after removal from the barrel 14 to pivot on said hook 26 through a sufficient angle and be released.

Figure 5:
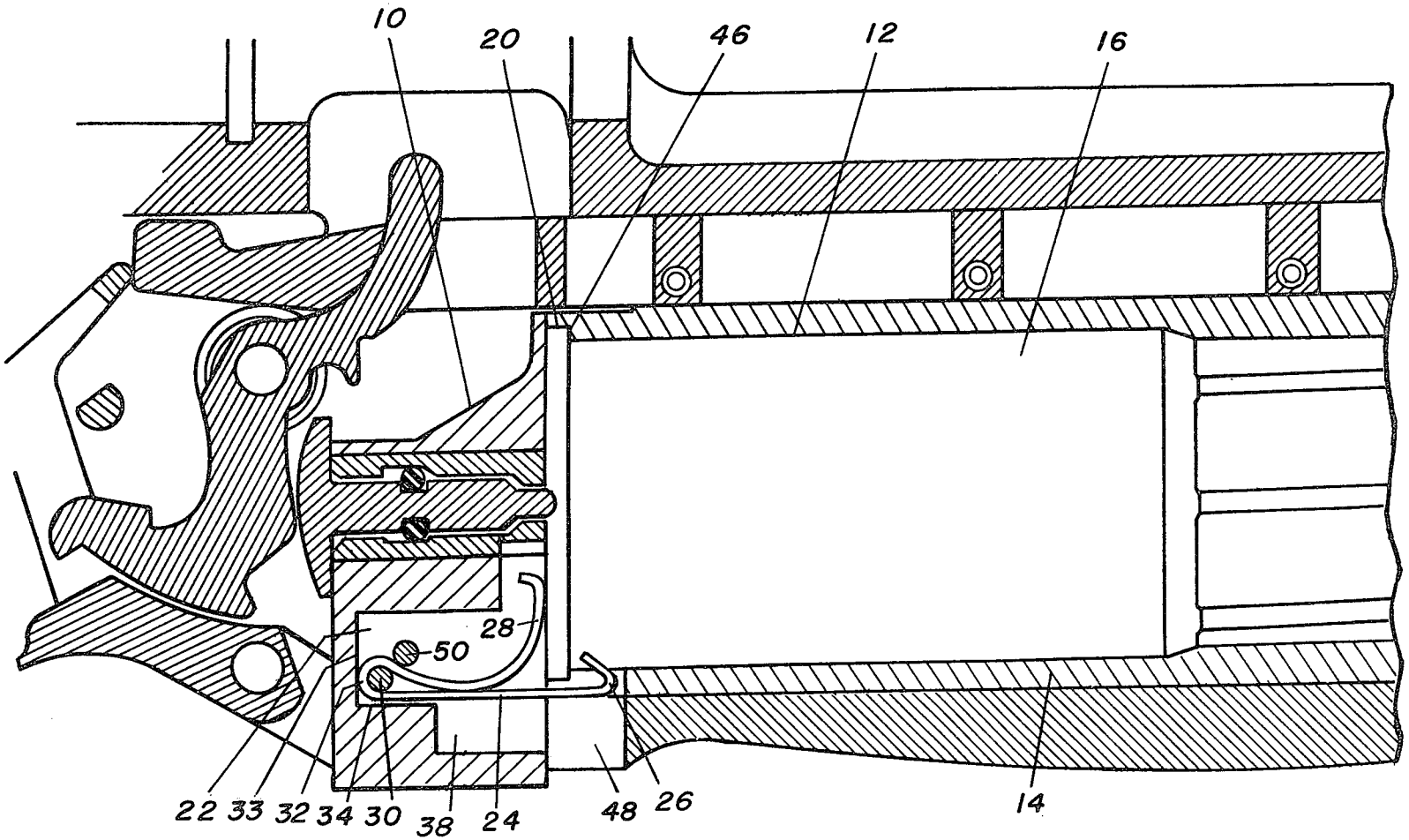
FIG. 5 is an axial section view of a portion of a firearm showing the breech bolt in firing position against a cartridge and breech designed to receive the entire length of the cartridge when the cartridge is fired.

FIG. 5 is a breech 12 with recesses 46 and 48, which receive the flanged rim 20 and extractor hook 26, respectively, and permit full insertion of the cartridge case 16 in the breech 12 while allowing the extractor-ejector device 24 to function in a manner substantially the same as that already described. However, in FIGS. 4 and 5, a pin 50 restrains the compression spring leg 28 against counterclockwise rotation and thereby functions similar to recess wall 36 in FIGS. 1, 2 and 3.

What is claimed is:

1. A device for extracting and ejecting a cartridge case having a flanged rear rim from a breech of a firearm comprising in combination:

a body movable in axial alignment with the breech and a hook means and a biasing means mounted in the body and projecting therefrom, wherein the hook means and the biasing means are combined in a unitary structure, wherein the hook means is adapted to slide over and engage the flanged rim on the rear end of the cartridge case and the biasing means is adapted simultaneously to press against the rear end of the case when the body is moved proximate to the case for engagement therewith, and wherein the biasing means and the hook means cooperate so that when the body is moved away from the breech sufficient to extract the engaged cartridge case therefrom, the biasing means causes the case to pivot on the hook means through a sufficient angle to disengage the rim from the hook means and thereby eject the case from the firearm.

2. The device of claim 1, wherein the unitary structure is a bifurcated piece of resilient material mounted in a recess in the body, one leg of the piece terminating in a hook and the other leg terminating in a spring.

3. The device of claim 2, wherein said bifurcated piece is held proximate to the closed end of a recessed cavity by a pin in the crotch of the piece.

4. The device of claim 3 wherein the walls of the recess restrain the legs of the piece so as to cause the hook to cam over and engage the flanged rim of the cartridge case.

5. The device of claim 3, wherein the spring leg is restrained by another pin and the hook leg is restrained by the adjacent recess wall so as to cause the hook to cam over and engage the flanged rim of the cartridge case.

6. The device of claim 3, wherein the resilient material is a steel strip.

* * * * *